US006422193B2

(12) United States Patent
Kawamoto

(10) Patent No.: US 6,422,193 B2
(45) Date of Patent: Jul. 23, 2002

(54) CRANK SHAFT SUPPORT STRUCTURE OF ENGINE

(75) Inventor: Yuichi Kawamoto, Akashi (JP)

(73) Assignee: Kawasaki Jukogyo Kabushiki Kaisha (JP)

( * ) Notice: Subject to any disclaimer, the term of this patent is extended or adjusted under 35 U.S.C. 154(b) by 0 days.

(21) Appl. No.: 09/771,846

(22) Filed: May 16, 2001

(51) Int. Cl.[7] ..... F02F 7/00
(52) U.S. Cl. ..... 123/195 R
(58) Field of Search ..... 123/196 R, 195 R

(56) References Cited

U.S. PATENT DOCUMENTS 4,854,274 A * 8/1989 Dingess ..... 123/192.1

FOREIGN PATENT DOCUMENTS

JP 2-29889 2/1983

JP 6-346713 * 12/1994

* cited by examiner

*Primary Examiner*—Noah P. Kamen
(74) *Attorney, Agent, or Firm*—Marshall, Gerstein & Borun

(57) ABSTRACT

A support structure of a crank shaft of an engine comprises a crank shaft 24 provided such that it penetrates through a crank case, including a crank pin portion situated in the crank case, to which a large end portion of a connecting rod is connected, and having one end portion to which a belt converter is connected; a first bearing for holding a portion of the crank shaft that penetrates through the crank case, which is close to the one end portion of the crank shaft, rotatably with respect to the crank case, the first bearing being constituted by a double row ball bearing; a second bearing for holding a portion of the crank shaft that penetrates through the crank case, which is close to the other end portion of the crank shaft, rotatably with respect to the crank case; and means for forcibly feeding lubricating oil from the other end portion's side of the crank shaft, through an oil passage formed inside of the crank shaft, and to a portion where a large end portion of a connecting rod and the crank pin portion are connected to each other.

6 Claims, 4 Drawing Sheets

CRANK SHAFT SUPPORT STRUCTURE OF ENGINE

BACKGROUND OF THE INVENTION

1. Field of the Invention

The present invention relates to a crank shaft support structure of an engine and, more particularly to a crank shaft support structure of an engine in which a belt converter is attached to an end portion of the crank shaft.

2. Description of the Related Art

In a vehicle that travels on rough terrain such as a straddle-type all terrain vehicle, a belt converter is attached to an engine for the purpose of facilitating speed change operation.

FIG. 4 shows an example of a crank shaft support structure of an engine of a straddle-type four wheel all terrain vehicle in which the belt converter is attached to an end portion of the crank shaft.

As shown in FIG. 4, in this engine, a crank shaft 102 penetrates through a wall portion of a crank chamber 101*a* of a crank case 101 and a wall portion of a chain chamber 101*b* of the crankcase 101. A pair of bearings 103, 104 are provided on the wall portion of the crank chamber 101*a* through which the crank shaft 102 penetrates, and a bearing 112 for the belt converter is provided on an outer wall portion 111 of the chain chamber 101*b* through which the crank shaft 102 penetrates. The crank shaft 102 is held by the pair of bearings 103, 104, and the bearing 112 for the belt converter such that the crank shaft 102 is rotatable with respect to the wall portion of the crank chamber 101*a* and the outer wall portion 111 of the chain chamber 101*b*.

A large end portion 104*a* of a connecting rod 104 connected to a piston 105 is connected to a crank pin 106 of the crank shaft 102 by means of a bearing 107. A belt converter 108 is attached to a portion 102*a* of the crank shaft 102 that is protruded from the wall portion of the chain chamber 101*b*. The belt converter 108 is attached such that a main shaft 109 is connected to the end portion 102*a* of the crank shaft 102 and a drive pulley 110 is attached to the main shaft 109. The bearing 112 for the belt converter is constituted by a double row ball bearing so that it withstands belt tension of the belt converter 108 because the bearing 112 is subject to the belt tension.

An oil passage 115 is formed through an inside of the outer wall portion 111 of the chain chamber 101*b*, an inner peripheral face of the outer wall portion 111 through which the crank shaft 102 penetrates, and inside of the crank shaft 102, to a portion 120 where the crank shaft 102 and the large end portion of the connecting rod are connected to each other. Through the oil passage 115, lubricating oil is forcibly fed by an oil pump (not shown) to the portion 120 where the large end portion of the connecting rod and the crank shaft 102 are connected to each other. Reference numeral 114 denotes a sprocket for driving a cam shaft (not shown).

Publication of Japanese Examined Patent Application No. Hei. 2-29889 discloses a general crank shaft support structure of an engine in which a bearing for supporting a crank shaft is constituted by a plain bearing, and from the plain bearing, oil is forcibly fed to a portion where a large end portion of a connecting rod and a crank shaft are connected to each other.

By the way, when the conventional engine is mounted on the straddle-type four wheel all terrain vehicle, the crank shaft 102 is placed in a lateral direction of a vehicle body. The conventional engine is a single-cylinder engine, but a two-cylinder engine is sometimes mounted. In this case, a width of the engine is increased because the number of cylinders is increased as compared to the case where the single-cylinder engine is mounted. When a total width of the engine and the belt converter is too large in the straddle-type four wheel all terrain vehicle, a rider straddling a seat makes contact with side faces thereof. Therefore, it is necessary to limit the engine width.

However, in the crank shaft support structure of the conventional engine, a portion to be supported by the bearing 112 for the belt converter and a portion in which the oil passage 115 is formed are required in a portion of the crank shaft 102 that is outwardly protruded from a wall portion of the crank chamber 101*a*. For this reason, the length of the crank shaft 102, and hence the width of the engine, are increased.

SUMMARY OF THE INVENTION

Under the circumstances, an object of the present invention is to provide a crank shaft support structure which is capable of reducing a length of a crank shaft of an engine to which a belt converter is attached.

To achieve the above-described object, according to the present invention, there is provided a crank shaft support structure of an engine comprising: a crank shaft provided such that it penetrates through a crank case, including a crank pin portion situated in the crank case, to which a large end portion of a connecting rod is connected, and having one end portion to which a belt converter is connected; a first bearing for holding a portion of the crank shaft that penetrates through the crank case, which is close to the one end portion of the crank shaft, rotatably with respect to the crank case, the first bearing being constituted by a double row ball bearing; a second bearing for holding a portion of the crank shaft that penetrates through the crank case, which is close to the other end portion of the crank shaft, rotatably with respect to the crank case; and means for forcibly feeding lubricating oil from the other end portion's side of the crank shaft, through an oil passage formed inside of the crank shaft, and to a portion where a large end portion of a connecting rod and the crank pin portion are connected to each other.

With this configuration, since the oil is fed to the portion where the large end portion of the connecting rod and the crank shaft are connected to each other, from an opposite side of the portion where the belt converter is provided, the belt converter can be provided adjacently to the first bearing. Also, a large load capacity is demanded of the bearing which is subjected to load from the belt converter, because it needs to withstand belt tension of the belt converter which is applied to the bearing in the radial direction thereof. Since the first bearing is constituted by the double row ball bearing with a load capacity large enough to withstand the belt tension, a bearing for the belt converter can be dispensed with. Consequently, the length of the crank shaft and hence, the width of the engine can be reduced.

In this case, the second bearing may be a plain bearing, the oil passage may be formed in the crank shaft such that the oil passage extends from a peripheral face of a portion of the crank shaft that is fittingly inserted into the second bearing, through the inside of the crank shaft, and to the portion where the large end portion of the connecting rod and the crank pin portion are connected to each other, and the means for forcibly feeding oil may be adapted to feed the lubricating oil to the second bearing, and forcibly feed the lubricating oil from the second bearing, through the oil passage, and to the portion where the large end portion of the connecting rod and the crank pin portion of the crank shaft are connected to each other. With this configuration, it is not necessary to provide an oil passage at a portion of the crank shaft that is situated outwardly of the second bearing. Consequently, the crank shaft can be further reduced.

These objects as well as other objects, features and advantages of the invention will become apparent to those skilled in the art from the following description with reference to the accompanying drawings.

DETAILED DESCRIPTION OF THE PREFERRED EMBODIMENTS

Hereinafter, an embodiment of the present invention will be described with reference to accompanying drawings.

Figure 1:
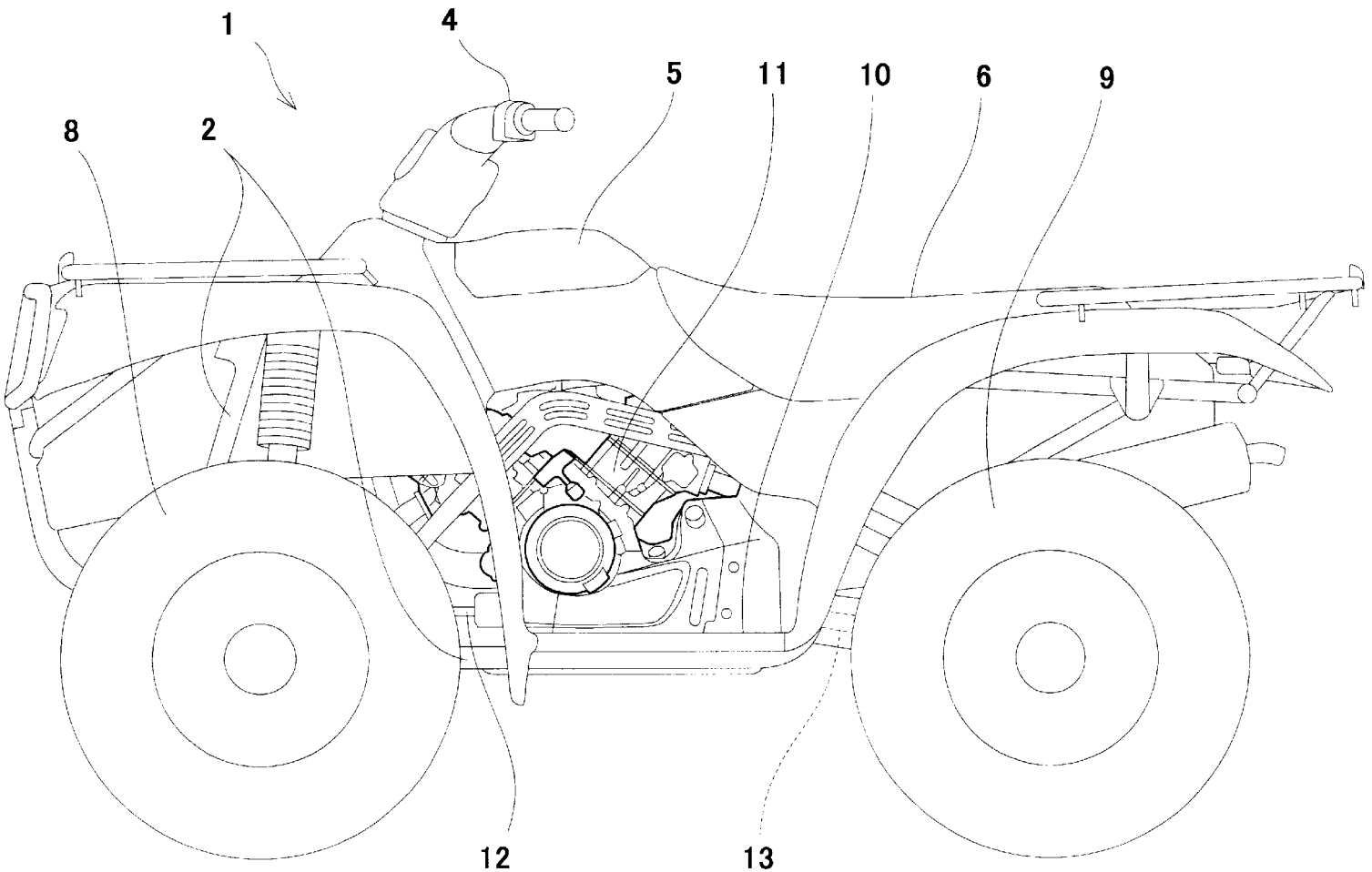
FIG. 1 is a left-side view showing an external appearance of a straddle-type four wheel all terrain vehicle on which a V-type engine having a crank shaft support structure according to an embodiment of the present invention is mounted.

FIG. 1 is a left-side view showing an external appearance of a straddle-type four wheel all terrain vehicle on which a V-type engine having a crank shaft support structure according to the embodiment of the present invention is mounted.

Referring now to FIG. 1, a straddle-type four wheel all terrain vehicle 1 comprises a handle 4 attached to a body frame 2 (a portion thereof is shown in FIG. 1), right and left front wheels 8, and right and left rear wheels 9. The straddle-type four wheel all terrain vehicle 1 further comprises a cover 5 placed rearward of the handle 4 such that it covers an upper portion of the engine, a seat 6 placed rearward of the cover 5, and foot boards 10 provided on opposite sides situated forward and downward of the seat 6 and at positions substantially as high as axles of the front wheels 8 and the rear wheels 9. The vehicle 1 is provided with a V-type two cylinder OHC four cycle engine (hereinafter also referred to as a V-twin engine) 11 below the cover 5 such that a lower end thereof is substantially as high as the foot boards 10. The V-twin engine 11 is placed such that the cylinders are inclined in a forward and rearward direction of a vehicle body. An output of the V-twin engine 11 is transmitted to a forward output shaft 12 and a rearward output shaft 13 provided substantially in the forward and rearward direction via a torque converter and a transmission gear unit. From the forward output shaft 12 and the rearward output shaft 13, the output is transmitted to the front wheels 8 and the rear wheels 9 via a differential unit (not shown).

In so configured straddle-type four wheel all terrain vehicle 1, a rider straddles the seat 6, put the rider's feet on the foot boards 10, and grips the handle 4 with both hands to operate the vehicle 1.

Figure 2:
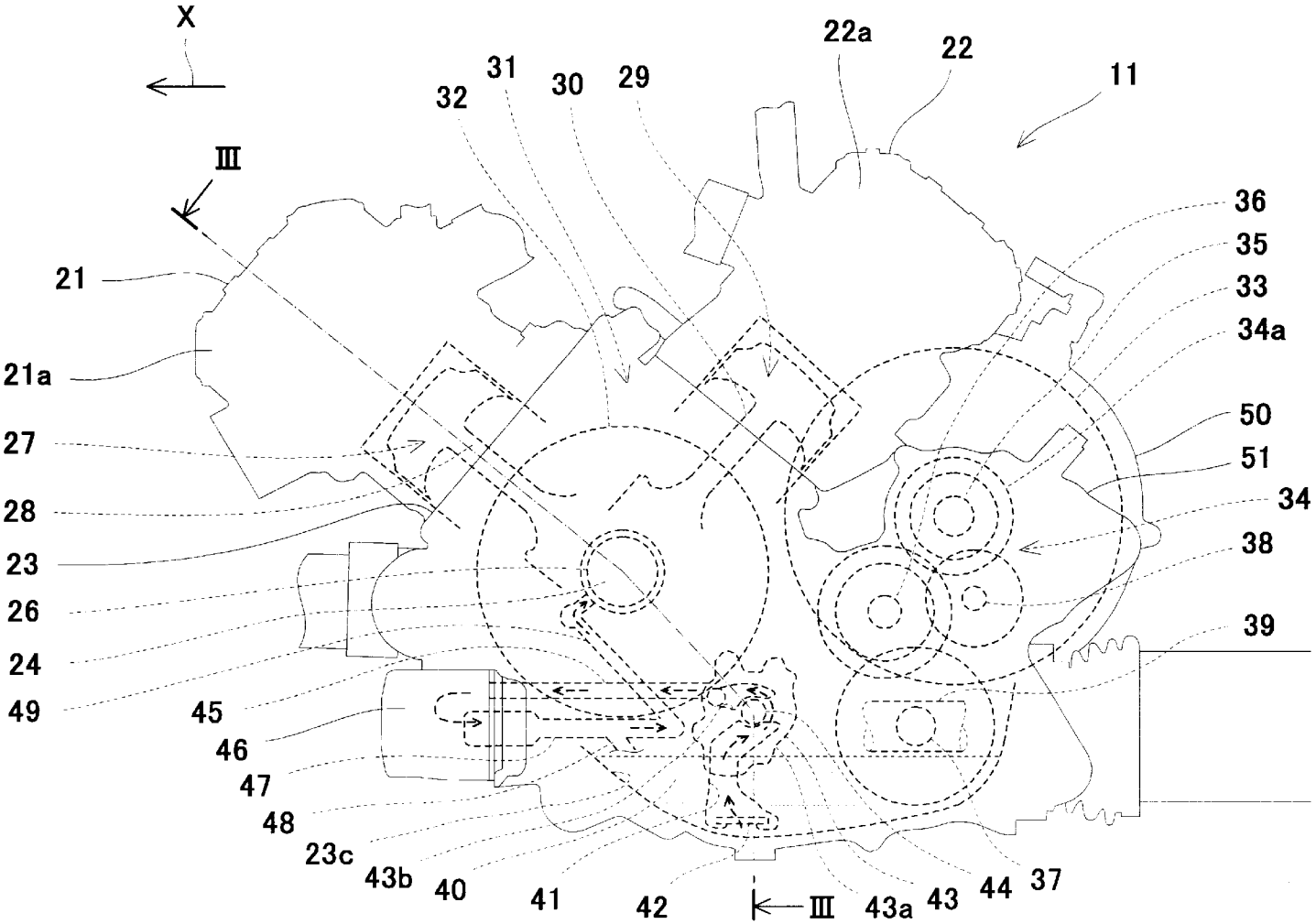
FIG. 2 is a left-side view schematically showing a structure of a V-type engine having the crank shaft support structure according to the embodiment of the present invention.
Figure 3:
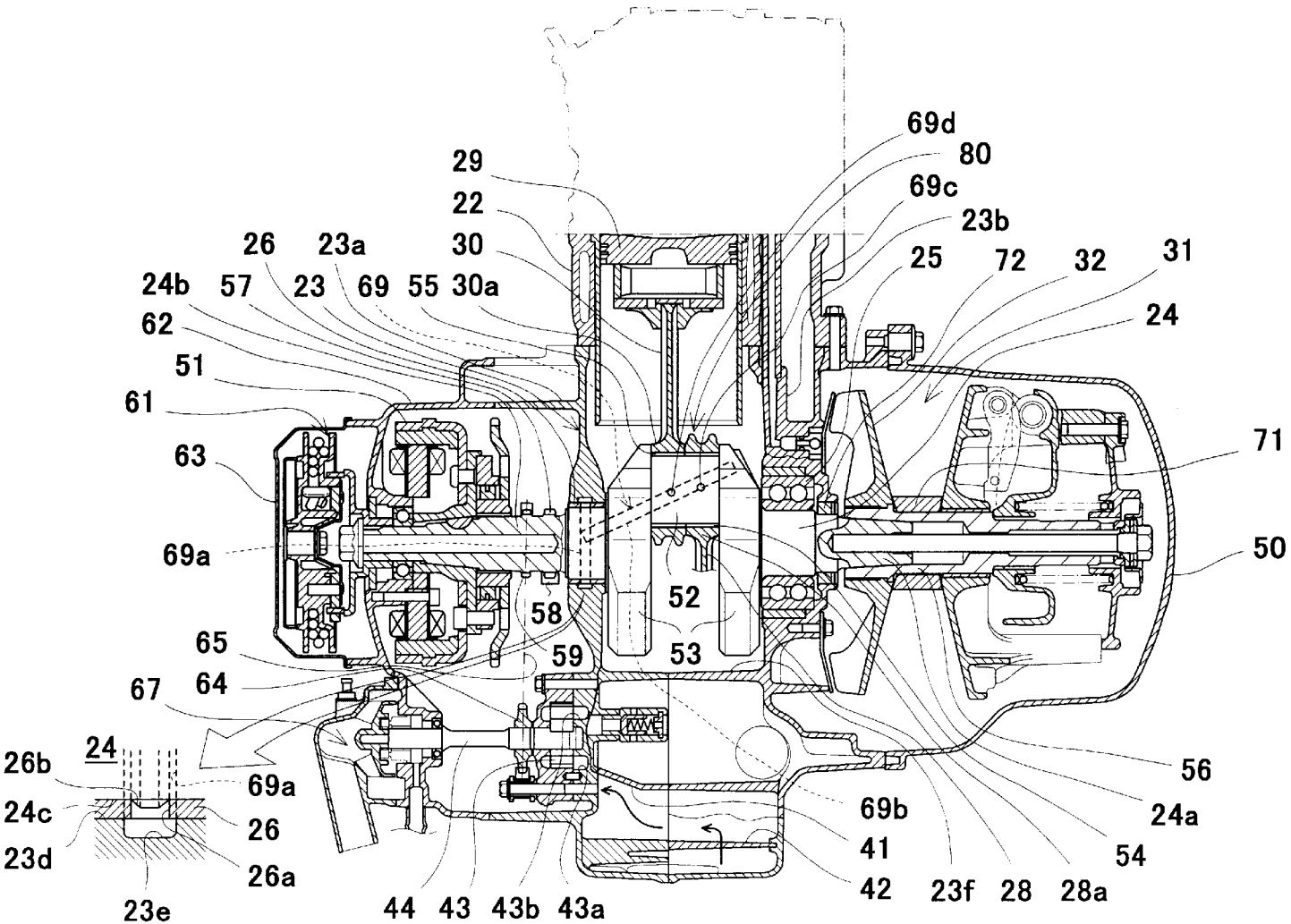
FIG. 3 is a cross-sectional view taken substantially along cut line III—III of FIG. 2.
Figure 4:
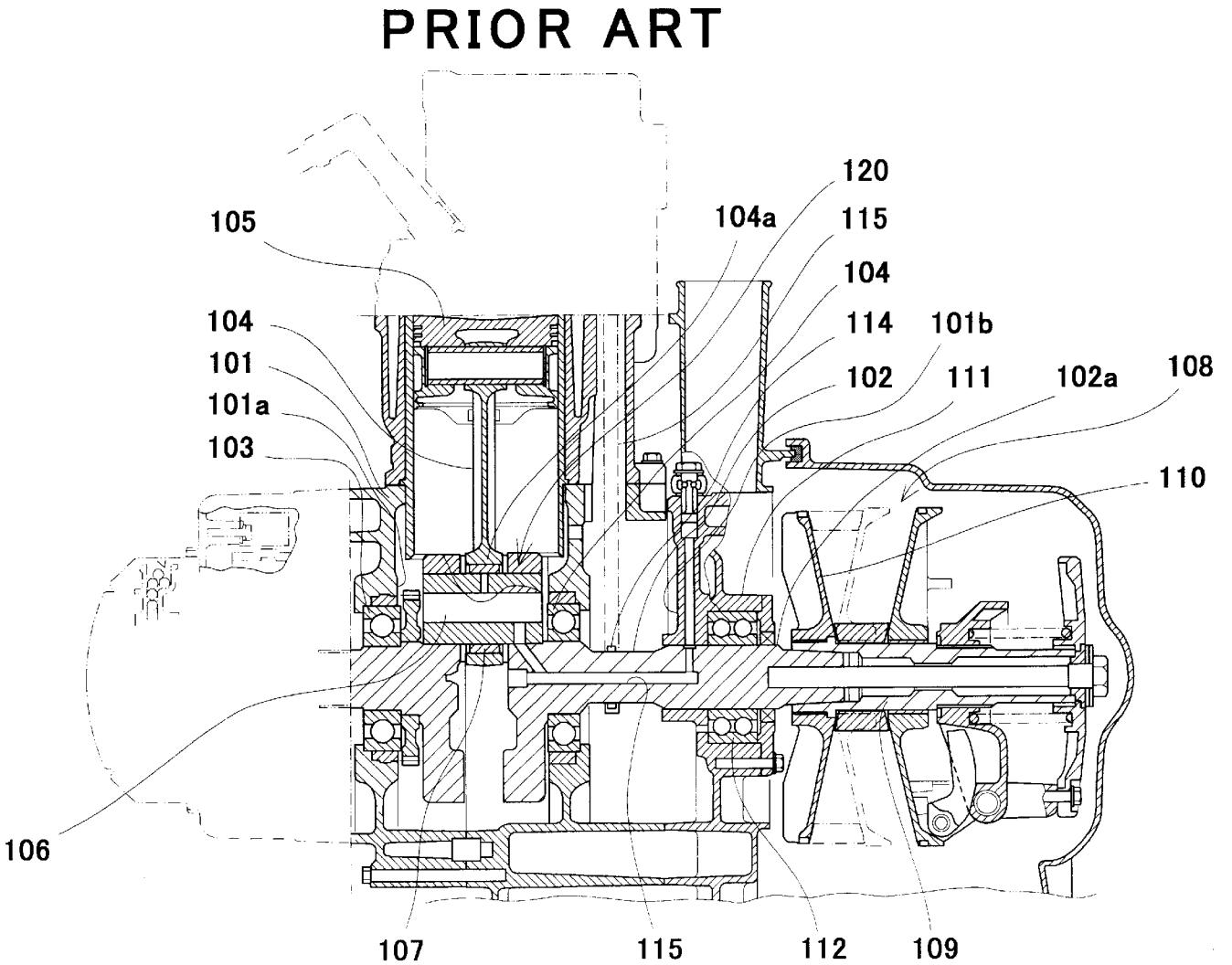
FIG. 4 is a cross-sectional view showing an example of the conventional crank shaft support structure of an engine to which a belt converter is attached.

FIG. 2 is a left-side view schematically showing a V-twin engine having a crank shaft support structure according to the embodiment of the present invention and FIG. 3 is a cross-sectional view taken substantially along cut line III—III of FIG. 2. In these FIGS., the V-twin engine is shown as being mounted on the straddle-type four wheel all terrain vehicle of FIG. 1. Therefore, X of FIG. 2 indicates a forward direction of the straddle-type four wheel all terrain vehicle of FIG. 1.

Initially, a power transmission mechanism and a circulating passage for lubricating oil of the V-twin engine 11 will be described with reference to FIG. 2. As shown in FIG. 2, in the V-twin engine 11, a crank shaft 24 penetrates through a crank case 23 in a rightward and leftward direction (see FIG. 3) and a forward cylinder 21 and a rearward cylinder 22 are arranged in an upper end portion of the crank case 23 such that the forward and rearward cylinders 21, 22 are widened in V-shape in the forward and rearward direction with a center axis of the crank shaft 24 as a center, as mentioned later.

A connecting rod 28 connected to a piston 27 of the forward cylinder 21 and a connecting rod 30 connected to a piston 29 of the rearward cylinder 22 are respectively connected to the crank shaft 24. An input shaft 35 of a transmission 34 is provided rearward of the crank shaft 24 and in parallel with the crank shaft 24. A belt converter 31 is placed between the input shaft 35 of the transmission and the crank shaft 24. Specifically, a drive pulley 32 is provided at an end portion of the crank shaft 24 and a driven pulley 33 is provided on the input shaft 35 of the transmission. A belt (not shown) is installed on the pulleys 32, 33 to interconnect them. An output shaft 39 is provided below the input shaft 35 of the transmission such that the output shaft 39 extends in the forward and rearward direction. The output shaft 39 and the input shaft 37 of the transmission are connected by means of the transmission 34. More specifically, an intermediate shaft 36, an idle shaft 38 for reverse, and a bevel gear shaft 37 are respectively provided below the input shaft 35 of the transmission and in parallel with the crank shaft 24. The four shafts including the input shaft 35 are connected to one another such that transmission ratios and rotational directions are changeable by a gear group 34*a* provided on these shafts.

A space below the piston 27 of the forward cylinder 21 and a space below the piston 29 of the rearward cylinder 22 communicate with an inner space of the crank case 23. A portion where each of the connecting rods 28, 30 and the crank shaft 24 are connected to each other is accommodated in the crank case 23. The transmission 34 is also accommodated in the crank case 23. An oil sump 40 is formed in a bottom portion 23*c* of the crank case 23. An oil pump (means for forcibly feeding oil) 43 is provided on a left side face of the crank case 23 (see FIG. 3). An oil passage 41 is provided such that an inlet thereof is situated in the oil sump 40 and an outlet thereof communicates with a suction port 43*a* of the oil pump 43. A primary filter 42 is provided at an inlet portion of the oil passage 41. A first oil passage 45 is connected to a discharge port 43*b* of the oil pump 43. A secondary filter 46 is connected to the first oil passage 45 and a main gallery 47 is connected to the secondary filter 46. A second oil passage 49 is formed from the main gallery 47 to a second bearing 26 supporting a left end portion of the crank shaft 24. As mentioned later, a third oil passage is formed from the second bearing 26 to the portion where each of the connecting rods 28,30 and the crank shaft 24 are connected to each other. An oil passage (not shown) is formed from the second bearing 26 to a head portion 21*a* of the forward cylinder 21. An oil passage 48 is formed from the main gallery 47 to the transmission 34. Thereby, the lubricating oil in the oil sump 40 is suctioned from the inlet of the oil passage 41 into the oil pump 43, the oil is then discharged from the discharge port 43*b* of the oil pump 43 and passes through the secondary filter 46, and the oil is then fed to the second bearing 26, the portion where each of the connecting rods 28, 30 of the forward and rearward cylinders 21, 22 and the crank shaft 24 are connected to each other, the head portion of the forward cylinder 21, the head portion of the rearward cylinder 22, and the transmission 34. The lubricating oil fed to these portions drops through the inside of the crank case 23, and is accumulated in the oil sump 40. As mentioned later, the belt converter 31 is accommodated in a space between a belt converter cover 50 provided on a right side face of the crank case 23 and a side wall of the crank case 23 (see FIG. 3).

Subsequently, the crank shaft support structure and a structure of the oil pump of the V-twin engine 11 will be described with reference to FIG. 3. As shown in FIG. 3, the crank case 23 is divided into a left crank case 23*a* and a right crank case 23*b*, which are joined to be formed into one crank case 23. The crank shaft 24 penetrates through the crank case 23 in the right and left direction. The first bearing 25 and the second bearing 26 are respectively provided at a portion of the right side wall of the crank case 23 through which the crank shaft 24 penetrates and at a portion of the left side wall of the crank case 23 through which the crank shaft 24 penetrates. The crank shaft 24 is held by the first bearing 25 and the second bearing 26 such that it is rotatable with respect to the crank case 23. The first bearing 25 is constituted by the double row ball bearing and the second bearing 26 is constituted by the plain bearing.

A crank web 53 and a crank pin 52 constitute a portion of the crank shaft 24 that is situated in the crank case 23. A large end portion 28*a* of the connecting rod 28 connected to the piston of the forward cylinder and a large end portion 30*a* connected to the connecting rod 30 of the piston 29 of the rearward cylinder 22 are respectively connected to the crank pin 52 by means of the bearings 54, 55.

The portion of the left side wall of the crank case 23 through which the crank shaft 24 penetrates corresponds to a cylindrical hole (hereinafter referred to as a bearing hole) 23*d*, into which the cylindrical second bearing 26 is fittingly inserted. A first annular groove 23*e* is formed in a circumferential direction of an inner peripheral face of the bearing hole 23*d*. The second oil passage 49 (see FIG. 2) communicates with the first annular groove 23*e*. A plurality of penetrating holes 26*a* are formed on a portion of an outer peripheral face of the second bearing 26 that is opposite to the first annular groove 23*e*. A second annular groove 26*b* is formed in an inner peripheral face of the second bearing 26 such that it connects the plurality of penetrating holes 26*a*. A third oil passage 69 is formed from a portion of the outer peripheral face of a journal portion 24*c* of the crank shaft 24 situated in the second bearing 26 that is opposite to the second annular groove 26*b*, through the inside of the crank shaft 24, and to the bearings 54, 55 of the portion 80 where each of the large end portions of the connecting rods 28,30 of the forward and rearward cylinders and the crank shaft 24 are connected to each other. The third oil passage 69 is constituted by a first conduit 69*a* formed from an outer peripheral face of the journal portion 24*c* to a central portion thereof, a second conduit 69*b* obliquely formed from the first conduit 69*a* to a central portion of the crank pin 52, and third and fourth conduits 69*c*, 69*d* formed from the second conduit 69*b* to an outer peripheral face of the crank pin 52.

A belt converter 31 is attached to a right end portion 24*a* of the crank shaft 24. The belt converter 31 is attached such that a main shaft 56 is integrally connected to the right end portion 24*a* of the crank shaft 24 and provided with the drive pulley 32. A belt 71 is installed on the drive pulley 31 and the driven pulley 33(see FIG. 2) to interconnect them. The belt converter 31 is covered by a belt converter cover 50 provided on the right side face of the crank case 23. A seal 72 is provided at an inner periphery of the portion of the right side face of the crank case 23, through which the crank shaft 24 penetrates, for preventing the oil from going into the belt converter 31.

A sprocket 57 for the intermediate shaft, a sprocket 59 for the pump drive shaft, a generator 51, and a recoil starter 61 are attached to the left end portion 24*b* of the crank shaft 24 from inwardly to outwardly in this order. The sprocket 57 for the intermediate shaft serves to drive the cam shaft of the forward cylinder and the cam shaft of the rearward cylinder 22 via an intermediate shaft chain 58, the intermediate shaft (not shown), or the like.

The interior of the crank case 23 is constituted by a crank chamber accommodating the crank web 53 and the crank pin 52 of the crank shaft 24, a transmission chamber accommodating a transmission 34 (see FIG. 2), and an oil chamber provided with an oil passage 41. These chambers are defined by separating walls and communicate with one another. A separating wall 23*f* defining the crank chamber and the oil chamber is shown in FIG. 3. The oil passage 41 has the inlet at which the primary filter 42 is provided and the outlet communicating with an intake port 43*a* of the oil pump 43 (see FIG. 2). The oil pump 43 is provided in a lower portion of the left side face of the crank case 23 and driven by the pump drive shaft 44. The discharge port 43*b* of the oil pump 43 communicates with the first oil passage 45(see FIG. 2). The pump drive shaft 44 is provided with a sprocket 64. A chain 65 is installed on the sprocket 64 and the sprocket 59 for the pump drive shaft to interconnect them. Thereby, the pump drive shaft 44 is driven by the crank shaft 24. Reference numeral 67 denotes a water pump coaxially attached to the pump drive shaft 44. Reference numeral 62 denotes a generator cover provided on the left side face of the crank case 23 such that it covers the sprocket 57 for the intermediate shaft, the sprocket 59 for the pump drive shaft, the generator 51, and the oil pump 43. Reference numeral 63 denotes a recoil starter cover provided integrally with the generator cover 62 such that it covers the recoil starter 61.

Subsequently, an operation of the crank shaft support structure of the V-twin engine so structured will be described. As shown in FIGS. 2, 3, when the piston 27 of the forward cylinder 21 and the piston 29 of the rearward cylinder 22 reciprocate, the crank shaft 24 rotates. This rotation is transmitted to the output shaft 39 via the belt converter 31 and the transmission 34. Meanwhile, the rotation of the crank shaft 24 drives the oil pump 43. Thereby, the lubricating oil is forcibly fed to the second bearing 26 and the portion 80 where each of the large end portions of the connecting rods 28, 30 of the forward and rearward cylinders 21, 22 and the crank pin 52 are connected to each other.

As described above, in this embodiment, the oil is fed to the portion where each of the large end portions of the connecting rods 28, 30 and the crank shaft 24 are connected to each other, from an opposite side of the portion where the belt converter 31 is provided, and the first bearing 25 is constituted by the double row bearing with a large load capacity. Therefore, since the belt converter 31 can be provided adjacently to the first bearing 25 and the bearing for the belt converter can be correspondingly dispensed with, the crank shaft 24 can be shortened. In addition, since the plain bearing is used as the second bearing 26 and the oil passage 69 is formed from the second bearing 26, through the inside of the crank shaft 24, to the portion 80 where each of the large end portions of the connecting rods 28, 30 and the crank pin 52 are connected to each other, it is not necessary to provide an oil passage at a portion of the crank shaft 24 that is situated outwardly of the second bearing 26, and the crank shaft 24 can be correspondingly shortened. Consequently, the width of the V-twin engine 11 can be reduced.

Thus, the V-twin engine 11 which employs the crank shaft support structure according to the embodiment is capable of reducing a width thereof. Therefore, this engine is suitable as the engine for the straddle-type four wheel all terrain vehicle.

While in this embodiment, the present invention is applied to the two cylinder V-twin engine, the present invention is applicable regardless of the number of cylinders and whether or not the engine is of V-type.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A crank shaft support structure of an engine comprising:

a crank case;

a crank shaft penetrating through the crank case and provided with a belt converter connected to one end portion thereof;

a double row ball provided on a side wall of the crank case which is close to the belt converter; and a plain bearing provided on a side wall of the crank case which is away from the belt converter, wherein the crank shaft includes crank webs, a crank pin, and crank journals, the crank pin and the crank webs are accommodated in the crank case, the crank pin is situated between the crank webs and a large end portion of a connecting rod is connected to the crank pin, the crank journals are formed such that they extend from side portions of the crank webs in the axial direction of the crank shaft, the double row ball bearing rotatably supports one of the crank journals, and the plain bearing rotatably supports the other of the crank journals.

2. The crank shaft support structure according to claim 1, wherein lubricating oil from a device for feeding lubricating oil is supplied to the crank pin through the plain bearing.

3. The crank shaft support structure according to claim 2, wherein an oil passage is formed such that the oil passage extends from the device for feeding lubricating oil provided with the crank case to an outer peripheral portion of the plain bearing, from the outer peripheral portion of the plain bearing to an oil groove provided on an inner peripheral face of the plain bearing, and then from the oil groove to an outer peripheral portion of the crank pin through the inside of the crank shaft.

4. The crank shaft support structure according to claim 3, wherein a portion of the oil passage reaching to the outer peripheral portion of the crank pin through the inside of the crank shaft comprises:

a first radial oil passage extending from an outer peripheral face of the crank journal in the radial direction;

an axial oil passage extending in the axial direction through the inside of the crank shaft from the first radial oil passage to the crank pin; and a second radial passage extending in the radial direction from the axial oil passage to the outer peripheral of the crank pin.

5. The crank shaft support structure according to claim 4, wherein the engine is a V-type engine with two cylinders, large end portions of two connecting rods are connected to the crank pin, and the second oil passage is provided to correspond to each of the large end portions of the connecting rods.

6. The crank shaft support structure according to claim 1, wherein the crank webs, the double row ball bearing, an oil seal for preventing oil from leaking into the belt converter, and the belt converter are adjacently disposed to one another in this order in the axial direction of the crank shaft.

* * * * *

UNITED STATES PATENT AND TRADEMARK OFFICE

CERTIFICATE OF CORRECTION

PATENT NO. : 6,422,193 B2
DATED : July 23, 2002
INVENTOR(S) : Yuichi Kawamoto

It is certified that error appears in the above-identified patent and that said Letters Patent is hereby corrected as shown below:

Title page,
Item [22], should read -- [22] Filed: January 29, 2001 --

Signed and Sealed this

Twelfth Day of November, 2002

*Attest:*

*Attesting Officer*

JAMES E. ROGAN
*Director of the United States Patent and Trademark Office*